US008881708B2

(12) United States Patent
Cleeves et al.

(10) Patent No.: US 8,881,708 B2
(45) Date of Patent: Nov. 11, 2014

(54) CONTROL OF COMBUSTION MIXTURES AND VARIABILITY THEREOF WITH ENGINE LOAD

(75) Inventors: James M. Cleeves, Redwood City, CA (US); Michael Hawkes, San Francisco, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 430 days.

(21) Appl. No.: 13/270,182

(22) Filed: Oct. 10, 2011

(65) Prior Publication Data

US 2012/0085319 A1 Apr. 12, 2012

Related U.S. Application Data

(60) Provisional application No. 61/391,502, filed on Oct. 8, 2010, provisional application No. 61/501,654, filed on Jun. 27, 2011.

(51) Int. Cl.
*F02D 11/10* (2006.01)
*F02M 9/02* (2006.01)

(52) U.S. Cl.
CPC ..... *F02D 11/105* (2013.01); *F02M 9/02* (2013.01)
USPC ..... 123/399; 123/339.12

(58) Field of Classification Search
CPC ..... F02D 9/00; F02D 9/02; F02D 35/00; F02D 41/14; F02D 41/18; F02D 41/30; F02D 11/10; F02D 31/00; F02D 41/08; F02P 5/15; F02B 27/0284; F02B 29/083; F02M 23/04; B60K 31/08; B60K 31/31; B60K 31/10; B60W 10/06; B60W 10/08
USPC ..... 123/295, 319, 339.12, 339.16, 360, 123/361, 399, 402, 403, 435
See application file for complete search history.

(56) References Cited

U.S. PATENT DOCUMENTS 4,261,315 A * 4/1981 Geiger et al. ..... 123/486
4,458,651 A * 7/1984 Inoue et al. ..... 123/492

(Continued)

FOREIGN PATENT DOCUMENTS

EP 0209073 A2 1/1987
GB 2119130 A 11/1983

OTHER PUBLICATIONS

International Search Report and Written Opinion dated Jan. 2, 2012, for corresponding PCT Application No. PCT/US2011/055502.

*Primary Examiner* — John Kwon
*Assistant Examiner* — Johnny H Hoang
(74) *Attorney, Agent, or Firm* — Mintz Levin Cohn Ferris Glovsky and Popeo, P.C.

(57) ABSTRACT

An internal combustion engine can be operated in response to a received first throttle control input in a first operating regime that includes delivering a first air-fuel mixture having a first air/fuel ratio to a combustion volume to deliver a first output power in a first output power range between zero and a transition output power level. The engine can be operated in response to a received second throttle control input in a second operating regime that includes delivering a second air/fuel ratio richer than the first air/fuel ratio to the combustion volume to deliver a second output power in a second output power range between the transition output power level and a maximum output power level. Related methods, systems, and article of manufacture are described.

28 Claims, 11 Drawing Sheets

(56) References Cited

U.S. PATENT DOCUMENTS

| | | | | |
|---|---|---|---|---|
| 5,150,680 | A * | 9/1992 | Nishimura | 123/399 |
| 5,431,242 | A * | 7/1995 | Iwata et al. | 180/197 |
| 5,765,372 | A * | 6/1998 | Mitobe et al. | 60/301 |
| 6,915,776 | B2 * | 7/2005 | zur Loye et al. | 123/304 |
| 7,216,638 | B1 * | 5/2007 | Burk et al. | 123/673 |
| 8,005,603 | B2 * | 8/2011 | Fisher et al. | 701/103 |
| 2002/0117130 | A1 * | 8/2002 | Toda | 123/73 A |
| 2004/0079334 | A1 * | 4/2004 | Hasegawa | 123/406.52 |
| 2004/0084026 | A1 | 5/2004 | Zhu et al. | |
| 2009/0139230 | A1 * | 6/2009 | Baldwin et al. | 60/612 |

* cited by examiner

800

CONTROL OF COMBUSTION MIXTURES AND VARIABILITY THEREOF WITH ENGINE LOAD

CROSS-REFERENCE TO RELATED APPLICATIONS

This application claims priority under 35 U.S.C. §119(e) to U.S. Provisional Patent Application Ser. No. 61/391,502 filed on Oct. 8, 2010 and entitled "Control of Combustion Mixtures and Variability Thereof with Engine Load," under 35 U.S.C. §119(e) to U.S. provisional patent application Ser. No. 61/501,654 filed on Jun. 27, 2011 and entitled "High Efficiency Internal Combustion Engine," and under 35 U.S.C. §120 to Patent Cooperation Treaty Application No. PCT/US2011/055502 filed on Oct. 8, 2011 and entitled "Control of Combustion Mixtures and Variability Thereof with Engine Load."

The current application is also related to co-pending and co-owned U.S. Pat. No. 7,559,298 entitled "Internal Combustion Engine," to co-owned U.S. Pat. No. 7,098,581 entitled "Spark Plug," to co-pending and co-owned international patent application no. PCT/US2011/027775 entitled "Multi-Mode High Efficiency Internal Combustion Engine," to co-pending and co-owned U.S. patent application Ser. No. 12/720,457 entitled "Over-Compressed Engine," and to co-pending and co-owned international patent application no. PCT/US2011/055457 entitled "Single Piston Sleeve Valve with Optional Variable Compression Ratio." The disclosure of each of the documents identified in this and the preceding paragraph is incorporated by reference herein in its entirety.

TECHNICAL FIELD

The subject matter described herein relates to internal combustion engines, and in particular, to internal combustion engine systems, methods, components, and the like that are capable of providing dynamically controlled combustion mixtures.

BACKGROUND

Internal combustion engines are commonly used to provide power for motor vehicles as well as in other applications, such as for example for lawn mowers and other agricultural and landscaping equipment, power generators, pump motors, boats, planes, and the like. For a typical driving cycle of a motor vehicle, the majority of fuel consumption may occur during low-load and idling operation of the vehicle's internal combustion engine. Similarly, other uses of internal combustion engine may also be characterized by more frequent use at a power output less than that provided at a wide open throttle condition. However, due to mechanical friction, heat transfer, throttling, and other factors that can negatively impact performance, spark ignition internal combustion engines inherently have better efficiency at high loads and poorer efficiency at low loads.

Part load operation of an internal combustion engine is typically achieved by restriction of airflow into the engine via operation of a throttle. A typical throttle control mechanism also includes a mechanical or computer-controlled system (e.g. a carburetor or fuel injector system) that regulates the delivery of fuel such that a constant air/fuel ratio is maintained.

The ratio of the air mass trapped in the combustion chamber in a given engine cycle to the maximum mass of air that could be contained in the combustion chamber at its intake density is generally referred to as the volumetric efficiency. When operating under full load conditions, the volumetric efficiency of an internal combustion engine is therefore advantageously as high as possible so that the mass of the air/fuel mixture, and hence the power output, is maximized. Accordingly, an internal combustion engine is conventionally designed to minimize restriction of air flowing into the engine, so that the air can be drawn into the cylinder as close as possible to atmospheric pressure.

However, when operating at part load, the throttle restricts the airflow into the engine, intentionally reducing the volumetric efficiency to reduce output as the air pressure in the intake manifold falls significantly below atmospheric pressure. To draw air from the manifold into the cylinder, the piston must therefore do work against the lowered pressure in the manifold. This excess work done by the piston as result of the pressure differential between the manifold and the crankcase is generally referred to as a pumping loss.

As an example, many conventional internal combustion engines are typically configured for a four-stroke Otto cycle, which includes an air/fuel inlet stage, an isentropic compression stage, a constant volume combustion stage, an isentropic expansion stage, a blowdown stage, and an exhaust stage. Movement of a piston or pistons within a cylinder causes compression of a fuel mixture in a combustion volume during the compression stage to the same degree that it expands during the power stage. The Otto cycle is generally characterized as having its best efficiency at high loads with substantially reduced efficiency at lower loads (e.g. while operating a throttled condition). Pumping loses against the throttle can also be significant. The symmetry of an Otto cycle can also lead to limited efficiency. In an Otto cycle engine, a throttle is typically used to limit the airflow for part-load operation. The throttle restricts the airflow into the manifold so that the engine pulls in air from this reduced pressure region, which generally results in the work to pump the air into the engine being higher than if the valves had been used to limit the airflow.

SUMMARY

In one aspect, a method includes receiving a first throttle control input that includes activation of a throttle control device within a first control range. The first throttle control input corresponds to a first output power of an internal combustion engine in a first output power range between zero and a transition output power level. The internal combustion engine is operated in a first operating regime in response to the received first throttle control input to deliver the first output power. The first operating regime includes delivering, to a combustion volume of the internal combustion engine, inlet air and fuel to produce a first air-fuel mixture within the combustion volume. The first air-fuel mixture includes a first air/fuel ratio. The method further includes receiving a second throttle control input that includes activation of the throttle control device within a second control range. The second throttle control input corresponds to a second output power of the internal combustion engine in a second output power range between the transition output power level and a maximum output power level of the internal combustion engine. The internal combustion engine is operated in a second operating regime in response to the received second throttle control input to deliver the second output power. The second operating regime includes delivering, to the combustion volume of the internal combustion engine, inlet air and fuel to produce a second air-fuel mixture within the combustion volume. The second air-fuel mixture includes a second air/fuel ratio that is richer than the first air/fuel ratio.

In an interrelated aspect, an apparatus includes a user-operable throttle control device operable to receive at least two throttle control inputs. The first throttle control input includes activation of the throttle control device within a first control range and corresponds to a first output power of an internal combustion engine in a first output power range between zero and a transition output power level. The second throttle control input includes activation of the throttle control device within a second control range and corresponds to a second output power of the internal combustion engine in a second output power range between the transition output power level and a maximum output power level of the internal combustion engine. A control mechanism causes the internal combustion engine to operate in a first operating regime in response to receiving the first throttle control input requesting the first output power in the first output power range. The first operating regime includes delivering, to a combustion volume of the internal combustion engine, inlet air and fuel to produce a first air-fuel mixture within the combustion volume. The first air-fuel mixture includes a first air/fuel ratio. The control mechanism further causes the internal combustion engine to operate in a second operating regime in response to receiving the second throttle control input requesting the second output power in the second output power range. The second operating regime includes delivering, to the combustion volume, inlet air and fuel to produce a second air-fuel mixture within the combustion volume. The second air-fuel mixture includes a second air/fuel ratio that is richer than the first air/fuel ratio.

In an interrelated aspect, a mixture control carburetor apparatus includes a fuel mixture control mechanism configured to receive at least a first throttle control input and a second throttle control input from a throttle control device. The first throttle control input includes activation of a throttle control device within a first control range and corresponds to a first output power of an internal combustion engine in a first output power range between zero and a transition output power level. The second throttle control input includes activation of the throttle control device within a second control range and corresponds to a second output power of the internal combustion engine in a second output power range between the transition output power level and a maximum output power level of the internal combustion engine. The fuel mixture control mechanism includes at least one of a variable fuel delivery rate feature providing airflow-independent control of a required air/fuel ratio, and an airflow dilution feature providing airflow-independent control of the required air/fuel ratio. The fuel mixture control mechanism produces a first air-fuel mixture that includes a first air/fuel ratio in response to receiving the first throttle control input and produces a second air-fuel mixture that includes a second air/fuel ratio in response to receiving the second throttle control input, the second air/fuel ratio being richer than the first air/fuel ratio.

In another interrelated aspect, an apparatus includes means for receiving a first throttle control input and a second throttle control input. The first throttle control input includes activation of a throttle control device in a first control range and corresponds to a first output power of an internal combustion engine in a first output power range between zero and a transition output power level. The second throttle control input includes activation of the throttle control device in a second control range. The second throttle control input corresponds to a second output power of the internal combustion engine in a second output power range between the transition output power level and a maximum output power level of the internal combustion engine. The apparatus also includes means for operating the internal combustion engine in a first operating regime in response to the received first throttle control input to deliver the first output power and in a second operating regime in response to the received second throttle control input to deliver the second output power. The first operating regime includes delivering inlet air and fuel to a combustion volume of the internal combustion engine to produce a first air-fuel mixture having a first air/fuel ratio within the combustion volume. The second operating regime includes delivering inlet air and fuel to the combustion volume of the internal combustion engine to produce a second air-fuel mixture having a second air/fuel ratio that is richer than the first air/fuel ratio within the combustion volume.

In some variations one or more of the following features can optionally be included in any feasible combination. A feedback can optionally be provided to the user, for example by a feedback mechanism or system, to indicate that the second control range has been activated. The feedback can optionally include at least one of an increased throttle control device motion resistance in the second control range relative to the first control range, a visual feedback, an auditory feedback, and a tactile feedback that is not related to motion resistance of the throttle control device. The first operating regime can optionally further include a first ignition timing and the second operating regime further comprises a second ignition timing that is retarded relative to the first ignition timing. Variation between the first air/fuel ratio and the second air/fuel ratio can optionally be provided by actuation of a throttle to control airflow to the internal combustion engine and concurrent, independent control of a delivery rate of fuel via one or more fuel injectors. The delivery rate of fuel via the one or more fuel injectors can optionally be controlled by a programmable processor that receives commands from the throttle control device. The throttle control device can optionally control operation of a mixture control carburetor that provides variation between the first air/fuel ratio and the second air/fuel ratio. The mixture control carburetor can optionally include one or more variable fuel delivery rate features to provide airflow-independent control of a required air/fuel ratio. The one or more variable fuel delivery rate features can optionally include separately actuated controls for movement of a slide that determines an airflow throat size and a tapered needle that is extendible and retractable from the slide into an orifice or jet to control a fuel delivery area of the orifice or jet. The one or more variable fuel delivery rate features can optionally include separately actuated controls for movement of a slide that determines an airflow throat size and a position of an orifice or jet into and out of which a tapered needle mounted on the slide is moved in concert with motion o the slide to control a fuel delivery area of the orifice or jet. The mixture control carburetor can optionally include one or more airflow dilution features that provide airflow-independent control delivery of a required air/fuel ratio. The one or more airflow dilution features can optionally include a secondary throttle metering airflow through a second air passage that dilutes air passing through a first airflow passage that comprises a controlled rate of fuel delivery from an orifice or jet.

Systems and methods consistent with this approach are described as well as articles that comprise a tangibly embodied machine-readable medium operable to cause one or more machines (e.g., computers, etc.) to result in operations described herein. Similarly, computer systems are also described that may include a processor and a memory coupled to the processor. The memory may include one or more programs that cause the processor to perform one or more of the operations described herein.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
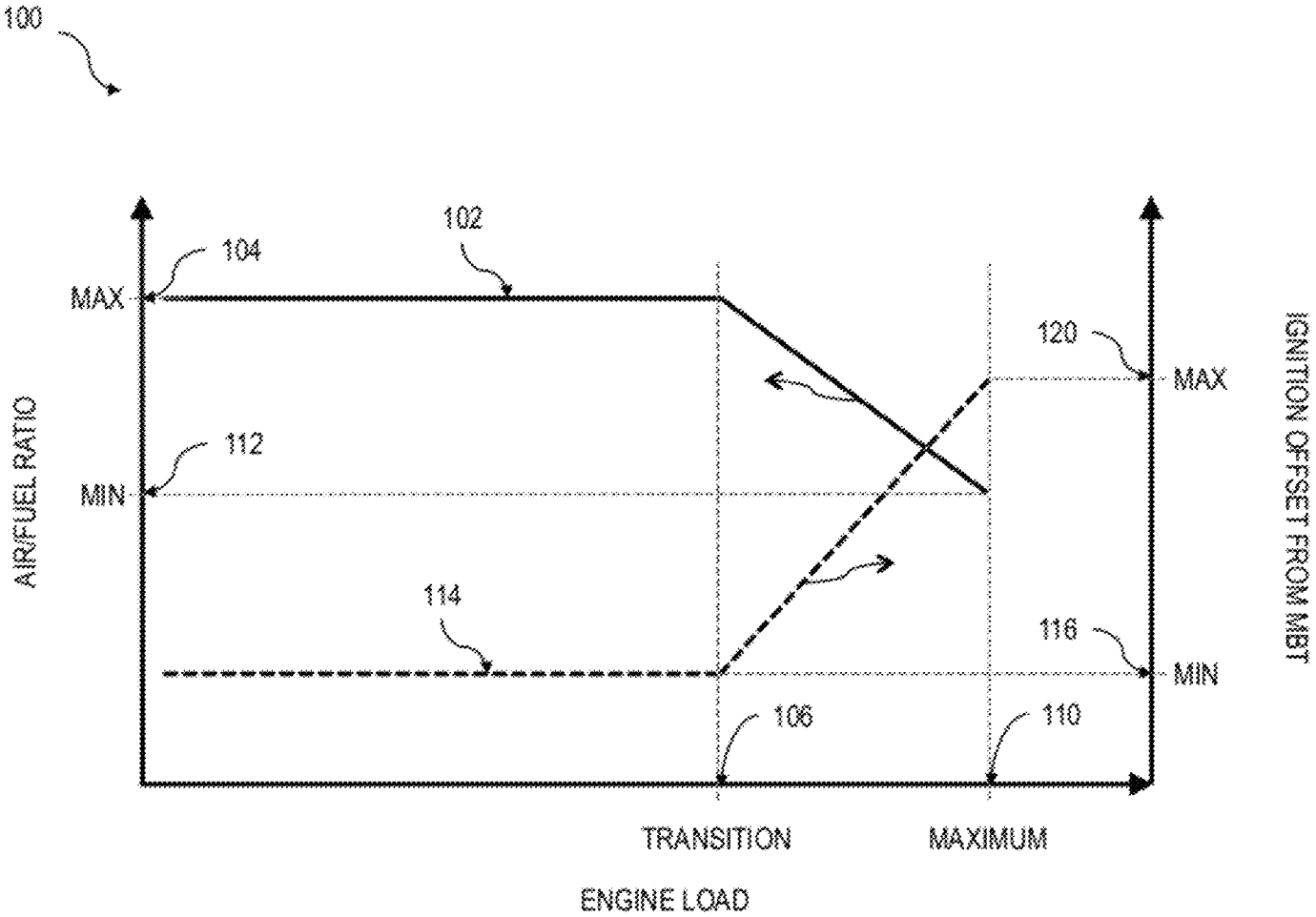
FIG. 1 is a chart illustrating an example of air/fuel ratio and ignition timing variations as a function of engine load for an internal combustion engine having features consistent with one or more features of the current subject matter.

Carburetors in current use in internal combustion engines are generally incapable of adjusting the delivered fuel-air ratio independent of the load on the engine. With a typical carburetor, a high airflow provides high power, while a lower air flow provides lower power. The fuel-air ratio delivered by the carburetor varies with the air flow rate. However, control of the fuel-air ratio independent of the airflow rate is generally not possible. Some engines, for example internal combustion engines consistent with one or more features described in co-pending and co-owned international patent application no. PCT/US2011/027775 filed on Mar. 9, 2011, U.S. patent application Ser. No. 12/720,457 filed on Mar. 9, 2011, require the ability to control the fuel-air ratio based solely on engine load independent of the total air flow. For example, such an engine can require a rich mixture at low speed but high load, which is a relatively low air flow condition, while requiring a leaner mixture at high engine speed and low load, which is a high air flow condition under which a conventional carburetor would typically provide a richer mixture. A computer-controlled fuel injection system can solve this problem, albeit with accompanying increases in complexity and cost.

One or more advantages of implementations of the current subject matter may accordingly provide methods, systems, articles of manufacture, and the like relating to control of a fuel-air mixture provided within a combustion volume of an internal combustion engine. In various implementations, the air/fuel ratio can be varied independently of one or more of engine speed, air flow, and the like.

In an example of an approach with beneficial effects in this and potentially other regards, a carburetor or fuel injection system can be configured so that the air/fuel mixture is maintained on the lean side of stoichiometric (i.e. more air than is necessary for a stoichiometric ratio of oxygen to fuel molecules) for enhanced fuel economy until a wide open or near wide open throttle condition is reached. In this manner, maximum airflow can be provided to the combustion volume at lower than maximum engine power, thereby reducing the effect of pumping losses and increasing engine efficiency, particularly in an engine configured to provide additional power by transitioning at wide open throttle to a progressively richer air/fuel mixture.

A lean mixture generally burns at a lower temperature and releases less energy than a stoichiometric mixture. Thus, an engine configured to run lean up to a first throttle condition (e.g. airflow rate) and to then transition to a regime in which airflow is maintained at a constant level while additional engine power is provided by a progressively richer fuel mixture can operate at maximum airflow while providing less than the maximum engine load and can likewise handle a range of engine loads while operating at the maximum airflow. Such an engine can provide substantial benefits in efficiency relative to conventional engine.

In one implementation of the current subject matter, a throttle control device is capable of providing an air/fuel ratio that is variable independently of an airflow rate into the combustion volume of an engine. As additional power is requested via operation of the throttle control while the engine is operating in a first, lower power, higher efficiency regime, a first level of resistive feedback force can be supplied to the user via the throttle control, which can be a throttle pedal, a twist grip, or the like. When additional power is requested from the operator (e.g. greater than that supplied in the first, lower power, higher efficiency regime), the throttle control can continue to allow further travel, but, optionally with greater feedback resistance, for example against a stronger spring or the like, to provide feedback to the operator informing him or her that the engine is operating in a second higher power, lower efficiency regime. In other implementations, a physical resistance feedback need not be provided upon transition to the second higher power, lower efficiency regime Instead, some other type of feedback, such as for example visual, auditory, tactile, or the like, can be provided upon activation of the throttle control device to request an engine power output that requires operation in the second regime.

In some implementations, the extra motion of the throttle control device can change the jet position in a carburetor to increase a fuel delivery rate or can cause a computer processor or other controller controlling operation of one or more fuel injector to increase the fuel delivery rate, for example by transitioning to a different part of a look up table. Examples of carburetor configurations consistent with one or more implementations of this feature are described in greater detail below. As the user demands output greater than the wide-open throttle lean power level (e.g. in excess of the transition power output level), the mixture can gradually increase from lean to richer (or less lean, depending on the engine configuration and/or other factors).

A maximum mixture richness can in some implementations be set to stoichiometric, or alternatively to richer than stoichiometric for maximum power. FIG. 1 shows a chart 100 illustrating an example of both ignition timing (for example, timing of the firing of one or more spark plugs in the combustion volume) advance or retardation (for example as measured by number of degrees before or after top dead center of a piston) and ignition retardation (delay) as a function of brake mean effective pressure (BMEP) for an implementation of the current subject matter. In various implementations, either or both of mixture enrichment (i.e. a decrease in the air/fuel ratio) and a retardation of the ignition timing can be used in an engine operating in a second, higher power regime past a transition engine load. The retardation of the ignition timing can also be actuated by motion by a user of the throttle control into a second resistance force indicating that the engine is being operated in a lower efficiency, higher power regime. Retarding the ignition timing can be helpful in avoiding premature ignition of the fuel mixture in the combustion volume and can be used to avoid or reduce engine "knock" at progressively richer mixtures. Further details regarding techniques for reducing knock are found in co-pending and co-owned international application no. PCT/US2011/027775.

Referring again to FIG. 1, the solid curve 102 shows an example of variation in an air/fuel ratio of the fuel mixture provided to the combustion volume of an engine as a function of the engine load or power output. As shown in FIG. 1, the air/fuel ratio 102 can be maintained at a maximum value 104 during a first engine operation regime up to a transition engine load or power output 106. For engine loads in excess of the transition load 106, the air/fuel ratio 102 can decrease, either linearly as shown in FIG. 1 or via some a curve with some other shape, until the maximum engine load 110 is reached concurrently with a minimum air/fuel ratio 112.

The dashed curve 114 in FIG. 1 shows an example of variation in ignition timing in the combustion volume of an engine as a function of the engine load or power output. As shown in FIG. 1, the ignition timing 114 can be maintained at a first, minimum retardation 116 from maximum brake torque (MBT) during the first engine operation regime up to the transition engine load or power output 106. For engine loads in excess of the transition load 106, the retardation of the ignition timing 114 can be increased to progressively later after MBT, either linearly as shown in FIG. 1 or via some a curve with some other shape, until the maximum engine load 110 is reached concurrently with a maximum ignition timing retardation 120.

In one example, the transition engine load 106 can occur at a BMEP of approximately 5-7 bar and the maximum engine load 110 can occur at a BMEP of approximately 9-12 bar. The air/fuel ratio, expressed as the actual ratio divided by a stoichiometric ratio (also referred to as λ), can be in a range of approximately 1.2 to 1.6 at its maximum value 104 (leanest mixture) during engine operation in the first, lower power regime and can approach approximately 1 (i.e. a stoichiometric ratio) or even as low as approximately 0.9 or 0.8 at its minimum value 112 (i.e. richest mixture) concurrent with supplying the maximum engine load 110 in the second, higher power engine operation regime past the transition 106. The minimum ignition timing retardation value 116 can in one example be approximately 0° (i.e. at approximately MBT) during the first, lower power regime and can approach approximately 30° past MBT at its maximum value 120 in the second, higher power engine operation regime past the transition 106. As a further note, while the air/fuel ratio curve 102 and the ignition offset from MBT curve 114 are depicted in FIG. 1 as having a slope of approximately zero in the first operating regime (i.e. power output below the transition engine load 106), the current subject matter is not limited to constant values of these parameters in the first operating regime. In an implementation, at least the air/fuel ratio can vary in the first operating regime, for example from λ of approximately 1.1 at an idle condition to λ of approximately 1.2 at a BMEP in a range of approximately 2 to 4 bar, and λ of approximately 1.4 at a BMEP in a range of approximately 5 to 7 bar. The ignition timing can be similarly varied throughout the first operating regime as well as in the second operating regime at higher engine loads than the transition engine load 106. The specific curves for air/fuel ration and ignition timing can be determined according to the parameters of a specific engine.

Figure 2:
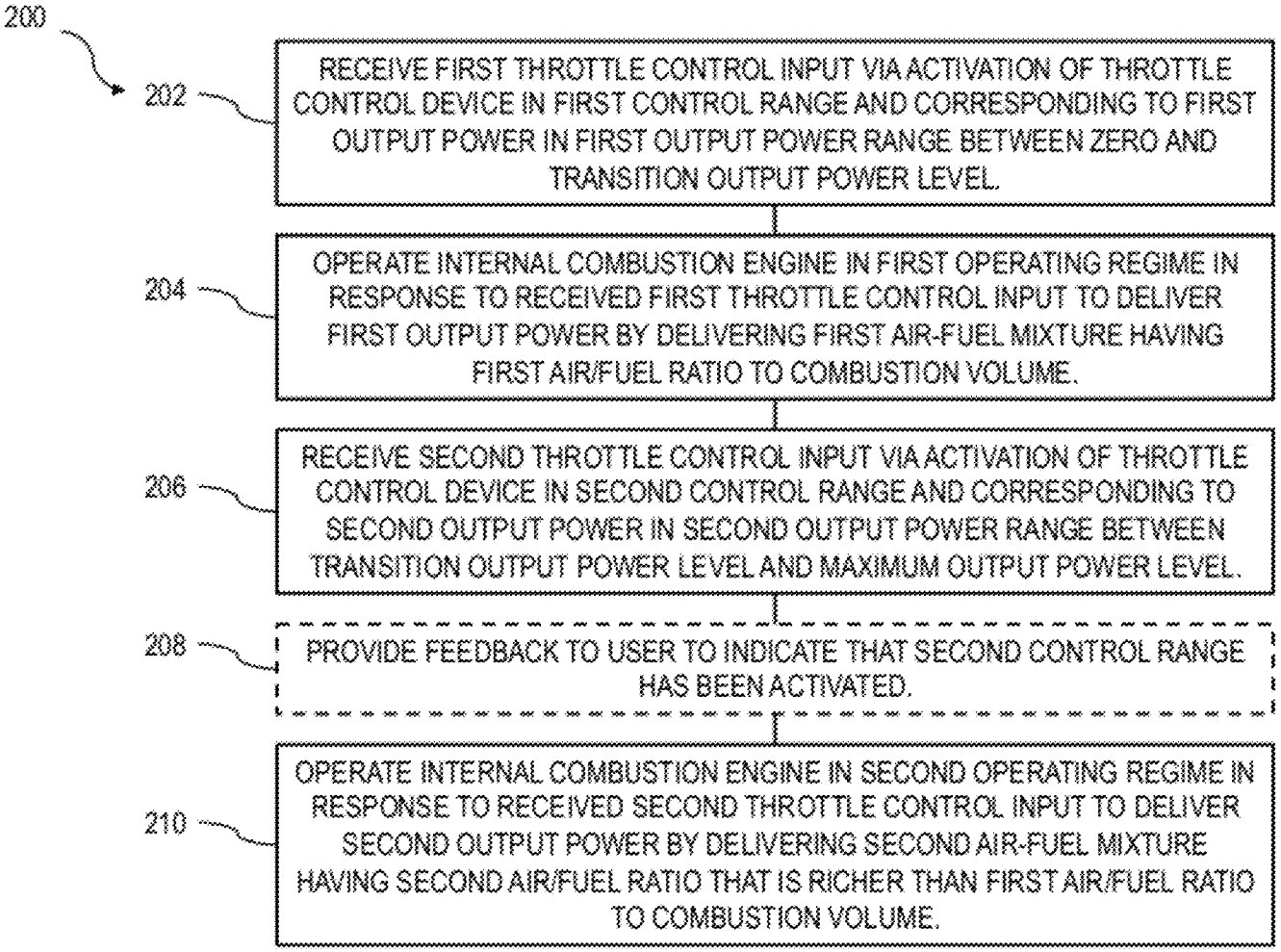
FIG. 2 is a process flow diagram illustrating aspects of a method having one or more features consistent with implementations of the current subject matter.

In accordance with one implementation of the current subject matter, a method can include one or more of the features illustrated in the process flow chart 200 of FIG. 2. At 202, a first throttle control input is received. The first throttle control input includes activation of a throttle control within a first control range and corresponds to a first output power of an internal combustion engine that is within a first output power range between zero and a transition output power level. At 204, the internal combustion engine is operated in a first operating regime in response to the received first throttle control input to deliver the first output power. The first operating regime includes delivering inlet air and fuel to produce a first air-fuel mixture having a first air/fuel ratio within a combustion volume of the internal combustion engine. At 206, a second throttle control input is received. The second throttle control input includes activation of the throttle control device within a second control range and corresponds to a second output power of an internal combustion engine that is within a second output power range between the transition output power level and a maximum output power level of the internal combustion engine. At 208, a feedback can optionally be provided to the user to indicate that the second control range has been activated, for example to indicate that the engine is being operated in a second operating regime that is less efficient than the first operating regime. The feedback can optionally include an increased physical resistance to movement of the throttle control device in the second control range relative to the first control range. The feedback can alternatively or additionally include one or more of visual, auditory, tactile (but not related to throttle control device resistance), or the like features to indicate to the user that the second operating regime is being used. In some implementations, a greater resistance of the throttle control device can be provided to ensure that the engine does not switch to the richer operating conditions of the second operating regime before reaching the maximum power available from the leaner, first operating regime. At 210, the internal combustion engine is operated in a second operating regime in response to the received second throttle control input to deliver the second output power. The second operating regime includes delivering inlet air and fuel to produce a second air-fuel mixture having a second air/fuel ratio that is richer than the first air/fuel ratio within the combustion volume.

The second operating regime can optionally also include a second ignition timing that is retarded relative to a first ignition timing used in the first operating regime. The retarded second ignition timing can reduce the occurrence of knock while the engine is operated in the second operating regime with a richer mixture that provides greater output power. The throttle control can be any type of throttle control device, including but not limited to a pedal, a rotating handle grip, a button, a lever, or the like. The throttle control can optionally be implemented in hardware, software, or a combination thereof. In an alternative implementation and consistent with the description above, any type of feedback indicating that the engine is operating in the second operating regime can be provided as non-physical feedback. For example, a visual prompt (e.g. a light, a message on a display screen, an electronic or mechanical flag, etc.) can be displayed to a user or an auditory feedback can be provided to indicate that the second operating regime is in effect. This feedback can be advantageous in keeping a vehicle operator informed of how his or her driving style is impacting fuel efficiency. With the second operating regime configured to provide additional power with a trade-off in efficiency, providing the operator with a better understanding of when this lower efficiency mode is activated can be useful in helping to improve more fuel-efficient use of the vehicle. A driver may choose to drive less aggressively if provided with feedback indicating that the higher power demand causes frequent use of the second operating regime with resultant lower fuel efficiency.

The air-fuel mixture can be delivered to the combustion volume using one or more methods that can include, but are not limited to, pre-mixing of air with fuel delivered to the intake air by one or more carburetors, pre-mixing of air with fuel delivered to the intake air by one or more fuel injectors, direct injection of fuel to the combustion volume, etc.

In an additional implementation, carburetor mechanisms capable of providing air/fuel ratio control independent of airflow are described. Conventional carburetors are generally configured to run at near stoichiometric air/fuel ratios for most of a speed/throttle range and to run rich for high power at a wide-open throttle condition. Such carburetors may not capable of performing in accordance with certain engine operation regime, including but not limited to those discussed above in reference to FIG. 1. An additional limitation of currently available carburetors and associated throttle control is the lack of a feedback feature to inform a user that the engine is currently operating in a less efficient regime.

One carburetor design that is used in many modern motorcycles makes use of a pressure difference in the throat of the carburetor to cause a diaphragm to lift the slide, which forms one side of the throat of the carburetor. The slide also carries a tapered needle, which fits into an orifice or jet connected to the fuel bowl on the bottom side of the throat. As the airflow increases, the diaphragm causes the slide to lift and keeps the velocity in the throat nearly constant over the load range. This configuration is typically referred to as a constant velocity carburetor. As the tapered needle is pulled up by the slide, the tapered shape of the tapered needle results is a decrease of the cross-sectional area of the tapered needle where the tapered needle interacts the orifice or jet, thereby resulting in a larger opening for the fuel to flow through. The fuel flow is accordingly increased in direct proportion to the airflow such that a constant air fuel ratio can be generally maintained over the airflow range.

Figure 3:
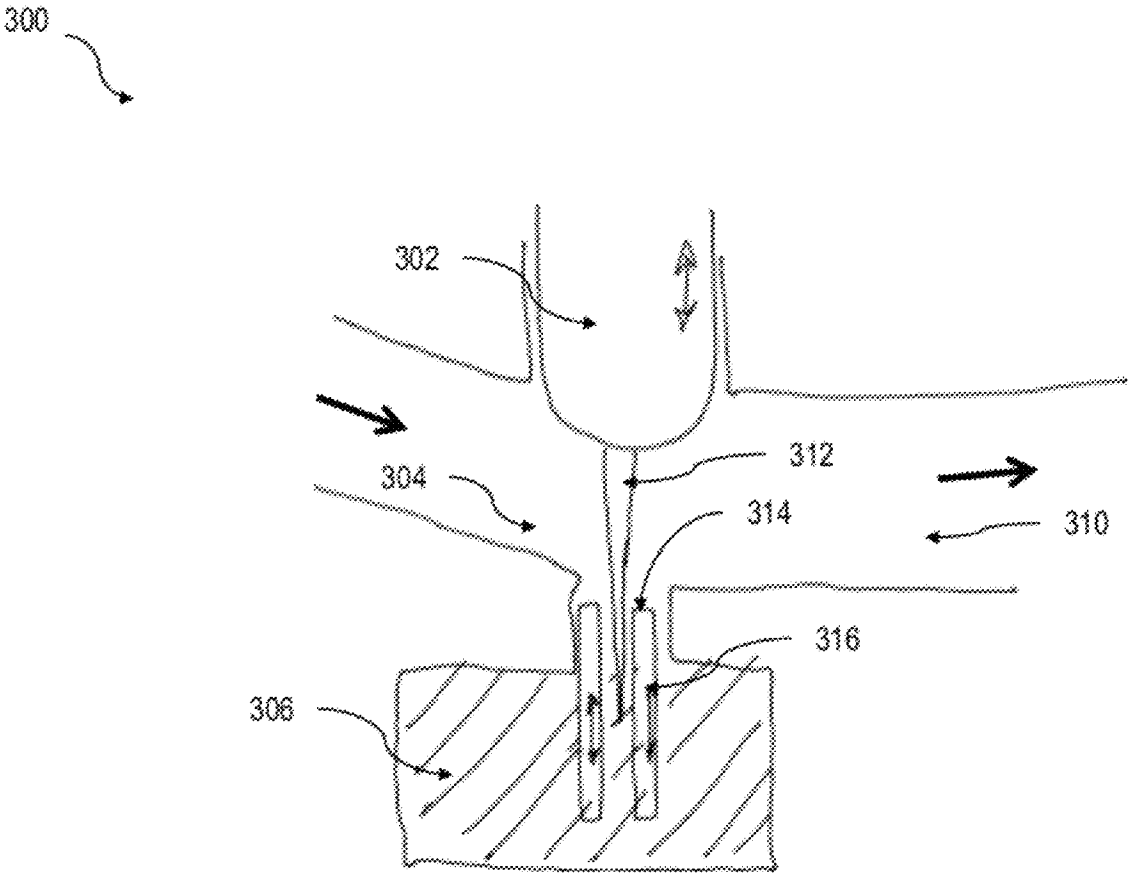
FIG. 3 is a schematic diagram showing features of a mixture-control carburetor having one or more features consistent with implementations of the current subject matter.

FIG. 3 shows a first example of a mixture control carburetor system 300 consistent with one or more implementations of the current subject matter and making use of variable fuel delivery rate features to provide airflow-independent control of an air/fuel ratio. Conventional carburetors generally provide only a two dimensional control on the air/fuel ratio. In other words, they can be set to provide an air/fuel ratio that is a function only of the airflow. Newly developed engines, including but not limited to those described in the applications and patents incorporated herein by reference, can require a three dimensional control of the air/fuel ratio as a function of at least airflow and engine load.

In one example, a carburetor can use a slide 302 to form a variable cross-sectional area for airflow 304 that generate a low pressure via the Venturi effect to aspirate fuel from a supply 306 into air passing through the airflow passage 310. Movement of a tapered needle 312 inserted into an orifice or jet 314 at an end of a fuel supply pipe 316 can control the amount of fuel allowed to flow. The tapered needle 312 can be attached to the slide 302. As the airflow is increased through the intake port 310, the slide 302 can be raised, and as it is raised the tapered needle 312 is pulled with it causing a smaller section to remain in the orifice or jet 314 of the fuel supply pipe 316, thereby allowing more fuel to flow. Use of a tapered needle 312 with a cross section that varies as a function of distance along the central axis of the tapered needle 312 can thereby allow fuel flow to increase in proportion to an increase in airflow while maintaining the air/fuel ratio.

Consistent with the current subject matter, the relative position of the jet 314 of the fuel supply tube 316 and the tapered needle 312 can be varied independently of the airflow based on the power output (engine load) requested from the vehicle operator. In a conventional carburetor, the orifice or jet 314 is typically located at the sidewall of the airflow passage 310 proximate to the location of the slide 302. In normal lean operation, the orifice or jet 314 can remain in that position. However in a load regime above the maximum available in lean operation, the orifice or jet 314 can be moved further away from the slide 302, for example by retracting the fuel supply tube 316 into the sidewall of the airflow passage 310, thereby resulting in a smaller cross section portion of the tapered needle 312 remaining in the orifice or jet 314 and an increased amount of fuel being delivered to the air passing through the airflow passage 310. More fuel is allowed to flow for the same pressure drop across the variable cross-sectional area for airflow 304 created by movement of the slide 302, and this results in a richer mixture.

The motion of the orifice or jet 314 can be linked to the throttle of the vehicle or engine. For example, the orifice or jet 314 can remain in a first, lean mixture position until the throttle is fully opened, and then further motion of a throttle cable via further operation of the throttle control by an operator at full open throttle can cause the orifice or jet 314 to begin to move. A range of enrichment required by the operating regime(s) of the engine can determine the necessary limit of travel of the orifice or jet 314.

As an illustrative and non-limiting example, if the normal operation was at a mixture of 20 parts air to 1 part fuel by weight (an air/fuel ratio of 20:1 which corresponds to $\lambda$ of approximately 1.4), and the second operating regime (e.g. as discussed above) provided an air/fuel ratio of approximately 14:1 at a maximum engine load condition, the required increase in fuel flow of approximately 30% from a lean condition to a fully enriched condition could mean that the jet would have to be able to move about 30% of the exposed length of the tapered needle 312 at maximum airflow. As such, the tapered needle 312 would need to be correspondingly long enough to insure that it does not become disengaged from the orifice or jet 314 at the full extent of its potential travel distance.

Figure 4:
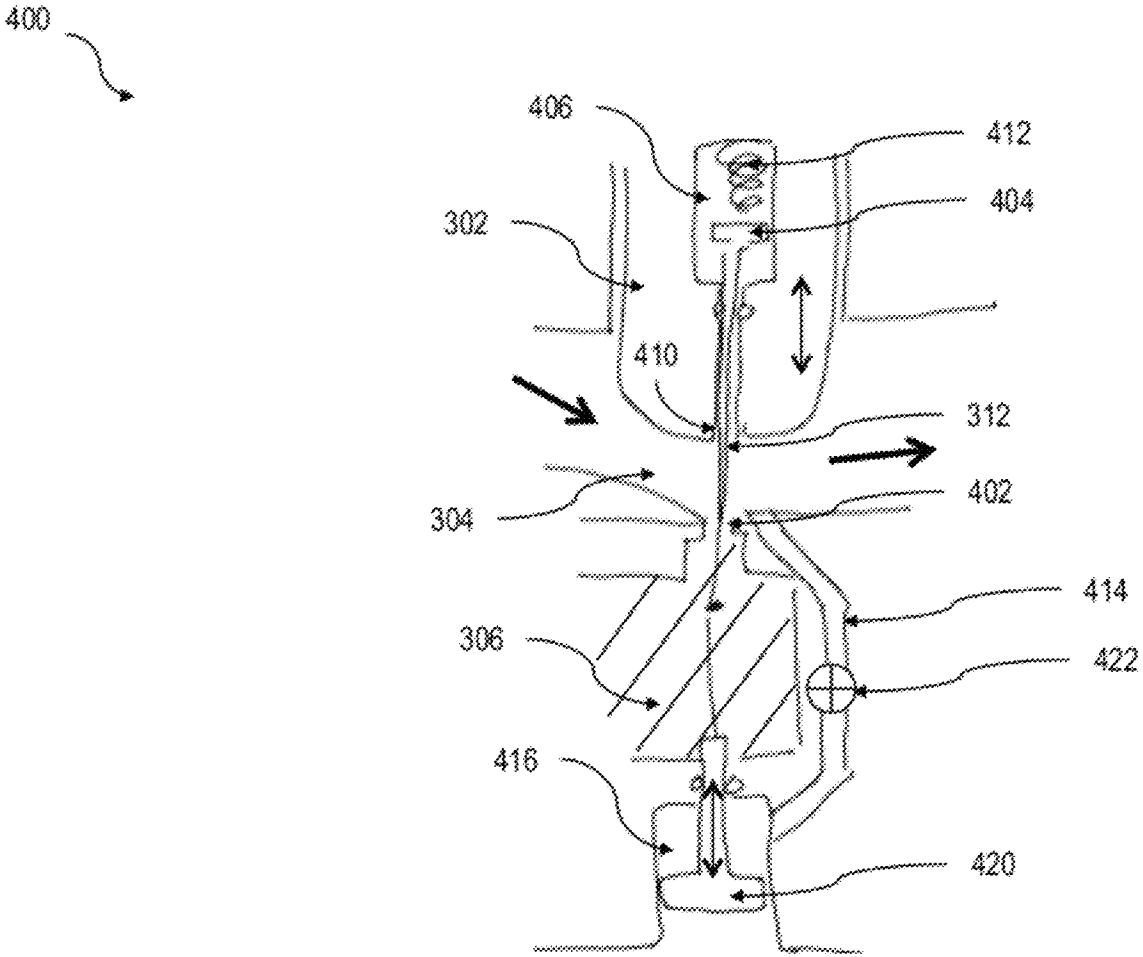
FIG. 4 is a schematic diagram showing features of another mixture-control carburetor having one or more features consistent with implementations of the current subject matter.

While a mechanism to adjust the position of the orifice or jet 314 in a stationary housing can advantageously be quite simple mechanically, a mixture control carburetor based on a moving orifice or jet 314 may experience difficulties with fuel becoming trapped in the opening leading to the moveable orifice or jet 314 and the airflow passage 310. On reduction of the load request from the operator and the resultant movement of the fuel supply tube 316 and the orifice or jet 314 back to its lean operation position, an extra quantity of fuel can be forced into the airflow passage 310, which can temporarily cause the mixture to go even richer. As such, it can be advantageous to minimize the void volume created by retraction of the moveable fuel supply tube 316 and orifice or jet 314 into the sidewall such that the volume of the potential extra quantity of fuel can be kept to an acceptable level. In one example consistent with an implementation, the fuel supply tube 316 can include a non-constant diameter such that the actual orifice or jet 314 has a significantly smaller diameter than the remainder of the fuel supply tube 316, thereby limiting the change in volume of the fuel supply tube 316 that results from movement of the tapered needle 312. A similar approach can also be used in a conventional needle valve that extends and retracts into a conventional carburetor orifice An alternative configuration can involve a fixed orifice or jet 402 in combination with a mechanism or mechanisms that allow movement of a tapered needle 312 along the direction of its axis independent of movement of the slide 302 as the engine load demands a richer mixture (such as for example if the second operating regime discussed above is in effect). FIG. 4 shows an illustrative, non-limiting example of a mixture control carburetor 400 having features consistent with this implementation and making use of variable fuel delivery rate features to provide airflow-independent control of an air/fuel ratio. The total length of the tapered needle 312 can generally have similar criteria to those discussed above, while the mechanism that connects the throttle cable, the butterfly and the mixture control to manipulate the relative position of the tapered needle in the moving slide can differ. In this configuration, there is no extra cavity of fuel that can lead to an undesired mixture change on engine load reduction.

One approach to move the tapered needle 312 inside the slide 302 can include fitting the tapered needle 312 with a first piston 404 that can slide within a first piston tube 406 inside the slide 302. One end of the first piston tube 406 can include an opening 410 through which the attached tapered needle 312 exits the slide 302, passes through the variable cross-sectional flow area throat 304 of the carburetor and on into the fixed fuel orifice or jet 402 on the other side of the throat 304. The first piston tube 406 can be vented to the throat region 304, for example via the opening 410, such that the pressure experienced by the first piston 404 can reflect the pressure at the throat 304. A spring 412 can be positioned in the first piston tube 406 to bias the first piston 404 and the attached tapered needle 312 further into the orifice or jet 402 to create a lean mixture. A bypass tube 414 can connect a second piston tube 416 positioned opposite from the slide 302 to the airflow passage downstream of the throat 304. A second piston 420 positioned in the second piston tube 416 can be connected to an end of the tapered needle 312 opposite the slide 302. When a valve 422 on the bypass tube 414 is closed, the second piston tube 416 can experience a similar pressure to that in the first piston tube 406, so the bias of the spring 412 can provide the lean mixture. When the valve 422 is open, however, the second piston tube 416 can experience a lower pressure, which can cause the second piston 420 to move the attached tapered needle 312 further out of the orifice or jet 402 to provide a richer mixture at a same airflow rate through the throat 304. This approach can allow for motion control of the needle without a mechanical connection to the slide.

Alternatively, the relative motion of the needle can be by a stationary rack working on an extended pinion that moves with the slide 302. When the rack rotates the pinion, the needle can be turned inside screw threads causing it to move relative to the slide. A rack and pinion configuration can include straight cut gear teeth or optionally other configurations. Alternatively, a cable can operate a scissors style mechanism and housing that is flexible to move with the slide 302. If the cable and housing are flexible enough, they can also act directly on the tapered needle 312 and the slide 302. Alternatively, the tapered needle 312 can be moved by the same style vacuum system used to move the slide 302.

Figure 5:
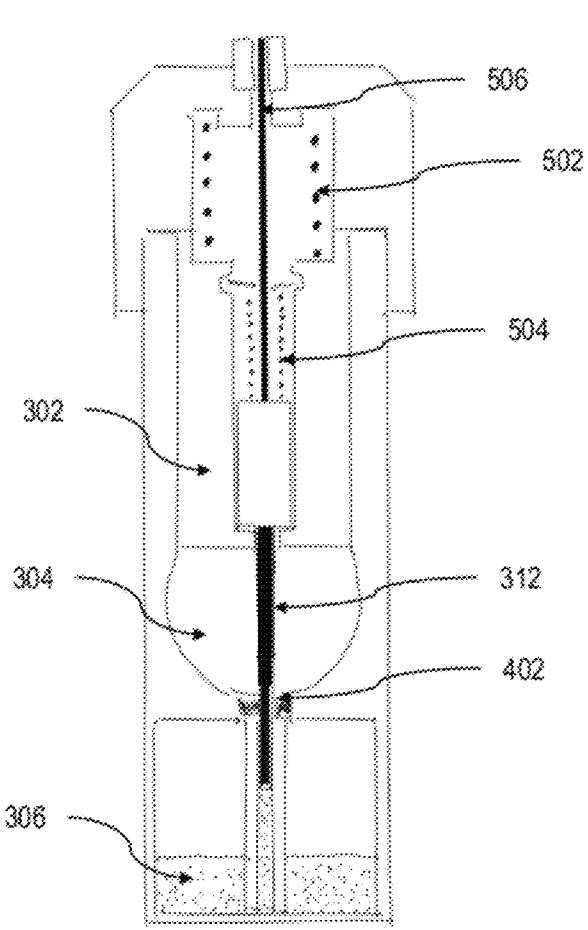
FIG. 5 is a schematic diagram showing features of another mixture-control carburetor having one or more features consistent with implementations of the current subject matter.

FIG. 5 shows another example of a mixture control carburetor 500 including features consistent with implementations of the current subject matter and making use of variable fuel delivery rate features to provide airflow-independent control of an air/fuel ratio. The tapered needle 312 in this carburetor configuration can move along the same axis of movement of the slide 302. However two bias springs can be used, a slide bias spring 502 and a needle bias spring 504, and the tapered needle 312 can move independently of the slide 302. The needle bias spring 504 can optionally be stiffer (e.g. more resistive to compression) than the slide bias spring 502 so that as a user operates a mechanical throttle control to request greater engine output power, for example by increasing or decreasing tension on a throttle cable 506, the slide 302 is retracted in the upward direction (based on the orientation shown in FIG. 5) before the tapered needle 312 is retracted into the cavity within the slide 302. Moving the slide 302 increases the cross-sectional flow area of the throat 304 in the airflow passage (which runs perpendicular to the plane of FIG. 5).

When the slide 302 reaches the end of its travel distance (full open throttle with maximum airflow to the engine), further operation of the throttle control to request additional engine output power causes the tapered needle 312 to begin to retract into the body of the slide 302 to create a smaller obstruction in the orifice or jet 402 so that the air/fuel ratio of the mixture becomes progressively richer. A flow rate of fuel from the fuel supply reservoir or "bowl" 306 to the air passing the throat 304 can be a function of the pressure difference between the bowl 306 and the Venturi pressure drop region at the throat 304 and the area of the orifice or jet 402. The area of the orifice or jet 402 can be controlled by the load demanded by the user via operation of the throttle control while air flow throw the throat 304 is a function of load demand and engine speed. The bowl pressure can be further varied by venting the fuel supply reservoir 306 (e.g. the bowl) to manifold pressure, atmospheric pressure, an additional Venturi region downstream of the throat 304, or a combination of pressure sources and bleed lines them, to compensate for changes in pressure drop at the throat 304 at different engine speeds.

Typically, the fuel supply reservoir 306 (e.g. the bowl) is at atmospheric pressure and the Venturi region of the throat 304 is at much less than atmospheric pressure. If the fuel supply reservoir 306 (e.g. the bowl) were vented to the Venturi region at the throat 304, there would be no pressure across the orifice or jet 402 and therefore no flow of fuel. Venting the fuel supply reservoir 306 (e.g. the bowl) to the Venturi region at the throat 304 and providing a bleed orifice from the atmosphere to enable control of the pressure between the that at the Venturi region and atmospheric pressure can provide low flow rates with low bleed and high flow rates with a large bleed opening in the bleed orifice. Changing the location of the low pressure side vent can alter the available pressure range. A high range can be provided at the Venturi region and a smaller range can be provided using the pressure downstream of the Venturi. The pressure behind the throttle can also be used. However, the low pressure that typically occurs at this location under low engine power can necessitate the use of additional control mechanisms or approaches. The size of the orifice or jet 402 can be used to control a bleed rate. For example, at low speed, low fuel flow rates, a small replenishment air flow can maintain the bowl pressure at a relatively high condition (e.g. approximately atmospheric pressure in some implementations) to boost flow. At higher fuel flow rates, the orifice or jet 402 can be unable to flow enough air to maintain the high bowl pressure. Accordingly, the boost pressure is reduced and can require augmentation. The size of the bowl air bleed orifice can be altered directly in parallel with the throttle demand if, for example, the slide was constructed with two needle valves, the first needle entering a first orifice to control fuel entering the throat, and the second needle valve entering a second orifice to control the bleed rate of air from the bowl into the throat and thus the pressure in the bowl. Alternatively, a single needle valve can control both fuel orifice and bleed orifice size, or a feature of the slide can interact with the throat body to form a variable bleed orifice size while the needle controlled fuel orifice size.

Figures 6A, 6B:
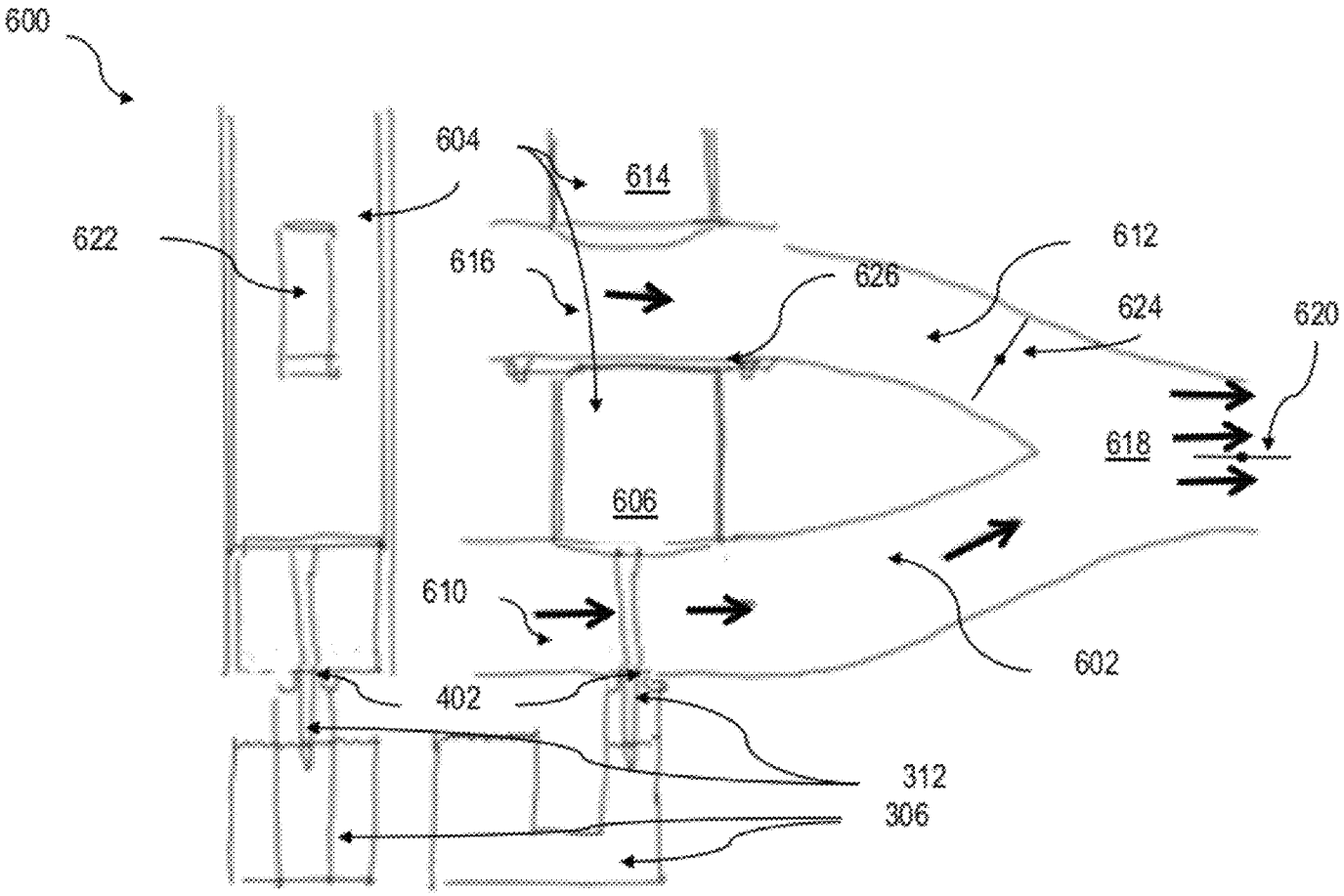
FIG. 6A and FIG. 6B are two schematic diagrams showing orthogonal cross-sectional views of a first mixture control operation mode of a mixture-control carburetor having one or more features consistent with implementations of the current subject matter.
Figures 7A, 7B:
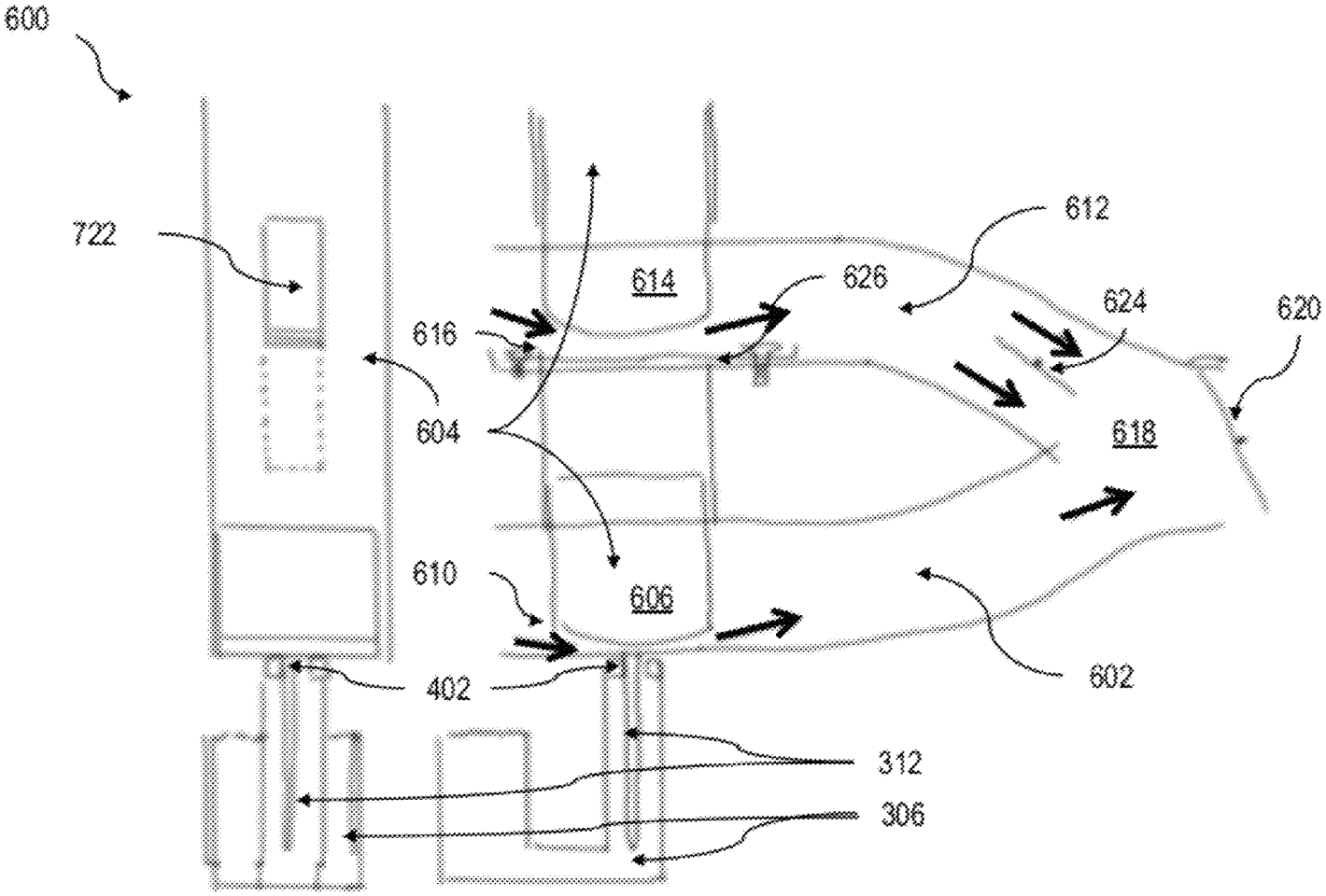
FIG. 7A and FIG. 7B are two schematic diagrams showing orthogonal cross-sectional views of a second mixture control operation mode of the mixture-control carburetor depicted in FIG. 6A and FIG. 6B.

FIG. 6A and FIG. 6B respectively show cross sectional views in a plane parallel to a direction of orthogonal and in a plane parallel to a direction of airflow in a mixture control carburetor 600 at a peak load, high power throttle condition. At peak load under high efficiency engine operating conditions (first operating regime), the secondary throttle 624 can be full open. For higher power but lower efficiency (e.g. in the second operating regime), the secondary throttle 624 can be closed so that only the mixture from the first airflow path 602 path is provided to the combustion volume, and the air/fuel ratio is reduced to generate a richer mixture. FIG. 7A and FIG. 7B shows similar views for the mixture control carburetor 600 under lower throttle operation. The mixture control carburetor 600 depicted in FIG. 6 and FIG. 7 makes use of airflow dilution features to provide airflow-independent control of an air/fuel ratio.

A first airflow passage 602 directs a first part of the intake air past an orifice or jet 402 controlled by motion of a tapered needle 312 connected to and moving in concert with a slide mechanism 604 that includes a first slide part 606 whose movement controls the cross sectional flow area of a first throat 610 in the first airflow passage 602. The first airflow passage 602 can be sized to supply all of the air and fuel needed by the engine for maximum load and speed. A second airflow passage 612 can include a second slide part 614 whose movement controls the cross sectional flow area of a second throat 616.

The second airflow passage 612 and second slide part 614 can be configured to provide an excess amount of air sufficient to create the maximum air/fuel ratio for which the engine is configured to run. For example, for a maximum air/fuel ratio corresponding to $\lambda=1.4$, the flow area of the second passage 612 and second slide part 614 can be configured to provide 40% of the area of the first airflow passage 602. The second airflow passage 612 does not, however, receive fuel via an orifice or jet. Instead, the air flowing through the second airflow passage 612 joins with and dilutes the air and fuel mixture provided via the first airflow passage 602 at a mixing region 618, but there would be no fuel delivery. The motion of the first slide part 606 and the second slide part 614 can be configured to cause the same pressure drop in both the first airflow passage 602 and the second airflow passage such that unobstructed flow (e.g. with each slide part fully retracted) results in a stoichiometric air-fuel mixture provided from the first airflow passage 602 and being diluted by an additional 40% of that airflow via the second airflow passage with no fuel added. When combined at the mixing region 618, this would result in a mixture with 40% excess air. The second airflow passage 612 can be sized to provide the leanest mixture required by the engine. When a richer mixture is needed, a secondary throttle in the second airflow passage can cause the second slide part 614 to be gradually closed, such that the air/fuel ratio of the mixture resulting at the mixing region 618 can be varied along a continuum from 40% excess air to no excess air.

Providing two passages configured with equal or at least approximately similar pressure drop vs. airflow rate per unit area properties can enable the approach of FIG. 6 to be usable at all engine speeds such that lean or rich operation is possible at both low speeds and high speeds. It will be well understood that while the example illustrated in FIG. 6 addresses an exemplary air/fuel ratio corresponding to $\lambda=1.4$ at the leanest operating condition, other air/fuel ratios can be provided based on the details described herein without the need for undue experimentation.

In operation, a carburetor having features similar to those shown in FIG. 6 and FIG. 7 can receive commands, for example via a throttle mechanism operated by a user to adjust a main throttle 620 for the desired load. A slot mechanism for changing an airflow passage size through a slot 622 can control operation of the secondary throttle 624 in the second airflow passage 612. When the main throttle 620 reaches a threshold point, for example 60% of maximum user demand, the end of the slot 622 can contact the actuator for the secondary throttle 624 controlling airflow through the second airflow passage 612. Between the threshold point of the main throttle 620 opening and full open, the secondary throttle 624 can progressively transition from full-open to full-closed in a manner that causes the air flow through the secondary airflow passage 612 to change in a well-controlled way. FIG. 6B shows the main throttle 620 in a full open position with the secondary throttle 624 in a full closed position such that a maximum mixture richness is delivered to give the highest power output. FIG. 7B shows the main throttle 620 at a lower airflow position while the secondary throttle 624 is full open to provide maximum dilution airflow and a large (i.e. lean) air/fuel ratio.

An insert 626 can optionally be provided to form a floor of the second airflow passage at the location of the slide mechanism 604. The insert can provide a same change in relative flow rate through each of the first airflow passage 602 and the second airflow passage 612 as the slide mechanism 604 changes position. In a constant velocity (CV) carburetor as noted above, the slide position can be controlled by a diaphragm and spring to maintain constant velocity in the throats 610, 616. Fuel is pulled up through the orifice or jet 402 by the reduced pressure at the first throat 610.

It can be advantageous for the airflow rate through the slot 622 (e.g. as controlled by an associated slot mechanism) or other flow controller on the secondary airflow passage 612 to be well defined, particularly if the engine is operated such that as the richness of the air-fuel mixture increases, the ignition or spark advance is retarded to reduce the occurrence of premature ignition or knock.

The flow rate of air through the second airflow passage and the spark advance curve can in some implementations be tightly correlated. In operation, tight coupling of mixture richness and spark delay can be achieved via a spark controller or, alternatively, via a cam or other mechanical actuation of a secondary throttle 624 to cause the mixture to change in a way that the spark controller can match. In another implementation, a position sensor on the slot 622 and/or an associated slot mechanism or some other control device on the second airflow passage 612 can be added to improve spark control.

In some implementations, the first airflow passage 602 and the second airflow passage 612 can be configured so that a single slide crosses both the first throat 610 and the second throat 616. The first airflow passage 602 that carries the air that receive fuel from the orifice or jet 402 can be positioned to be at the end of the slide, such that the tapered needle 312 can meter the fuel appropriately. However, the second airflow passage 612 can be positioned above the fueling passage, with a hole drilled through the slide to meter the diluting air passing through the second airflow passage 612. Alternatively, a rod can connect the first slide part 606 and the second slide part, or notches taken from the side of the slide, to provide desired flow properties. The second airflow passage 612 can be oblong or rectangular, rather than round, so that the same area change occurs in the second airflow passage 612 as in the first airflow passage 602 with its larger diameter.

A single-slide method can be also applied to simpler carburetors with directly actuated slides. For example, a top passage (equivalent to the second airflow passage 612) and a bottom passage (equivalent to the first airflow passage 602) can be operated with a single actuator. As noted above, it can be beneficial or otherwise advantageous for both passages to be at least approximately the same height and rectangular and for the width of the respective passages to be configured to provide the desired maximum dilution ratio. If one or both of the airflow passages are round, it can be more difficult to coordinate the motion of the two slides to ensure that the correct balance of air flows through the first airflow passage 602 and second airflow passage 612. In another implementation, the main throttle 620 can be eliminated if the slide mechanism 604 provides throttle control. The secondary throttle 624 is still required in this implementation to provide control over how much dilution air is provided via the second airflow passage 612.

Figure 8:
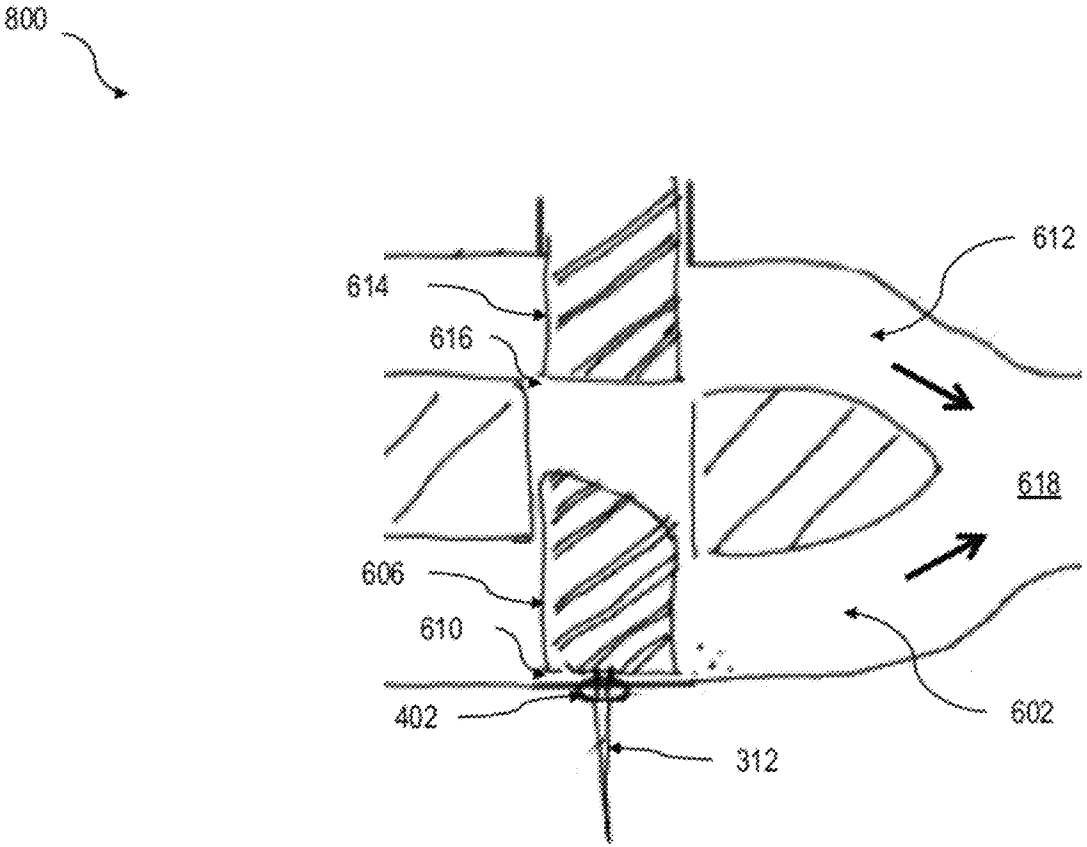
FIG. 8, FIG. 9, and FIG. 10 are schematic diagrams showing features of another mixture-control carburetor having one or more features consistent with implementations of the current subject matter.
Figure 9:
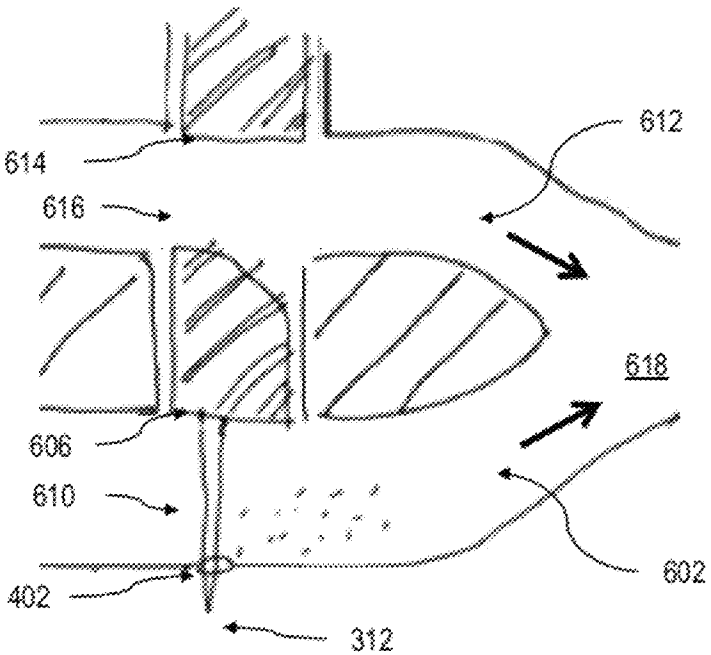
Figure 10:
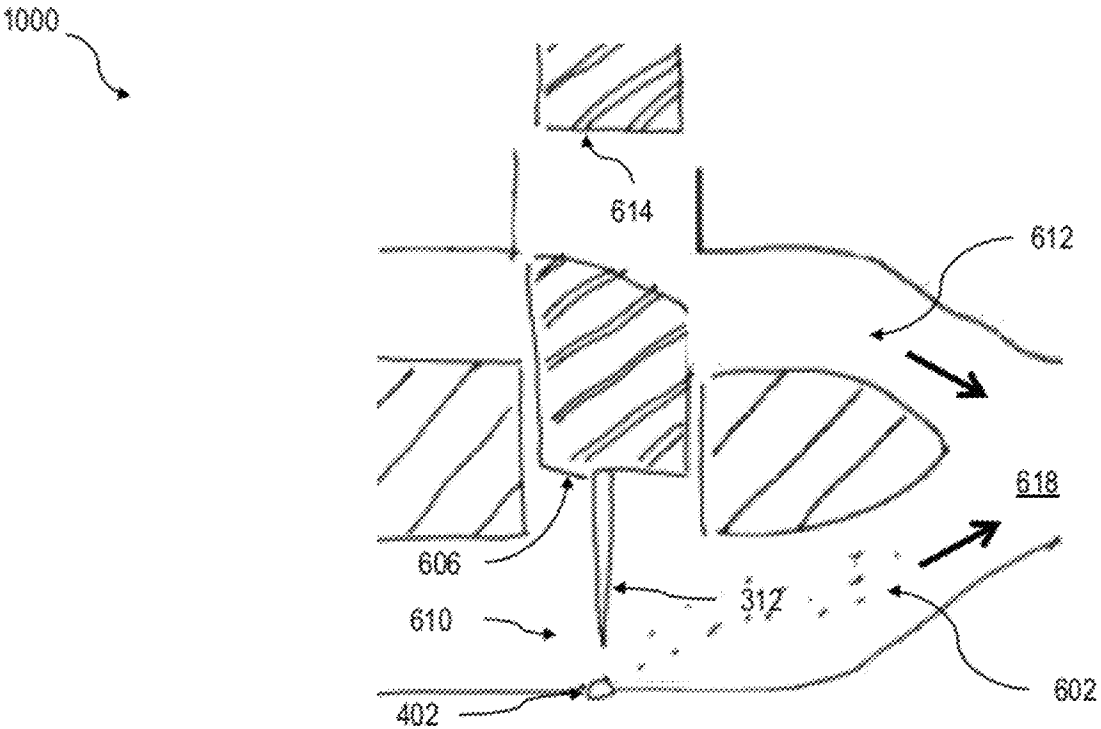

FIG. 8, FIG. 9, and FIG. 10 show schematic views of another mixture control carburetor 800 consistent with implementations of the current subject matter. FIG. 8 shows the carburetor 800 in an engine idle condition, FIG. 9 shows the carburetor 800 in a maximum power, maximum efficiency condition, and FIG. 10 shows the carburetor 800 in a maximum power condition (e.g. at the transition power output as discussed above). The mixture control carburetor 800 depicted in FIG. 8, FIG. 9, and FIG. 10 makes use of airflow dilution features to provide airflow-independent control of an air/fuel ratio.

As in FIG. 7 and FIG. 8, the mixture control carburetor 800 of FIG. 8, FIG. 9, and FIG. 10 includes two airflow passages 602, 612. The first airflow passage 602 directs air past an orifice or jet 402 that supplies fuel to the air under control of a tapered needle 312 attached to a first slide part 606 that is pushed into and retracted from the orifice or jet 402 by movement of the first slide part 606. A second airflow passage 612 provides air that does not pass by a fuel source and that dilutes the air-fuel mixture at a mixing region 618. As shown in FIG. 8, FIG. 9, and FIG. 10, the first slide part 606 can include an upper edge that is angled or otherwise pitched to have an increasing section where the upper edge intersects the second airflow passage 612. Accordingly, both the bottom edge of the second slide part 614 and the top edge of the first slide part 606 can be used to restrict flow through the second airflow passage 612 depending on the needed throttle setting and required air/fuel ratio of the provided mixture.

At an idle condition as shown in FIG. 8, the slide parts 606 and 614, which are part of a single slide mechanism, can be in a fully extended position such that the second slide part 614 completely blocks airflow through the second airflow passage and 100% of a very small airflow passes through the first throat 610 created by the bottom edge of the first slide part 606. As all of the airflow is through the first airflow passage, the air/fuel ratio can be approximately stoichiometric (e.g. $\lambda$ of approximately 1).

FIG. 9 shows a full dilution configuration of the carburetor 800, which can correspond to power outputs up to the transition power output as discussed above. As shown in FIG. 9, the first slide part is positioned to be blocking none of the flow through either of the first airflow passage 602 or the second airflow passage 612, and the second slide part 614 is fully retracted to also not block the second airflow passage. The airflow rate ratio that the second airflow passage 612 and the first airflow passage 602 are configured to provide will correspond to the generated air/fuel ratio of the resulting mixture at the mixing region 618. For example, if the second airflow passage 612 is configured to provide 40% of the airflow through the first airflow passage, the resulting air/fuel ratio can be approximately equivalent to a $\lambda$ of approximately 1.4 assuming the air flowing through the first airflow passage 602 is provided with a stoichiometric amount of fuel.

FIG. 10 shows a full power configuration of the carburetor in which the air-fuel mixture provided at the mixing region 618 has a stoichiometric ($\lambda$ of approximately 1) air/fuel ratio, which can correspond to the maximum engine power output as discussed above. In this configuration, the upper edge of the first slide part 606 can block the second airflow passage 612 such that all of the air flows past the orifice or jet 402. A smoothing plate may be added to the bottom of the first slide part 606, through which the fuel-metering needle valve passes and is retained to the first slide part 606 by a spring. This blocking plate can be held against the bottom of the first slide part 606 during the first regime of fuel mixture, and would stop against the wall of the first airflow passage 602 to provide smooth flow through the first throat 610 as the slide 604 enters the high-power enrichment region.

Figure 11B:
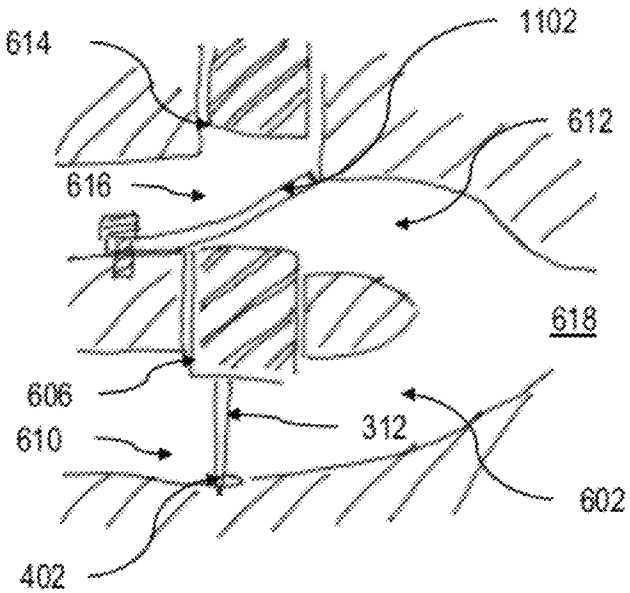
FIG. 11A and FIG. 11B are schematic diagrams showing features of another mixture-control carburetor having one or more features consistent with implementations of the current subject matter.
Figure 11A:
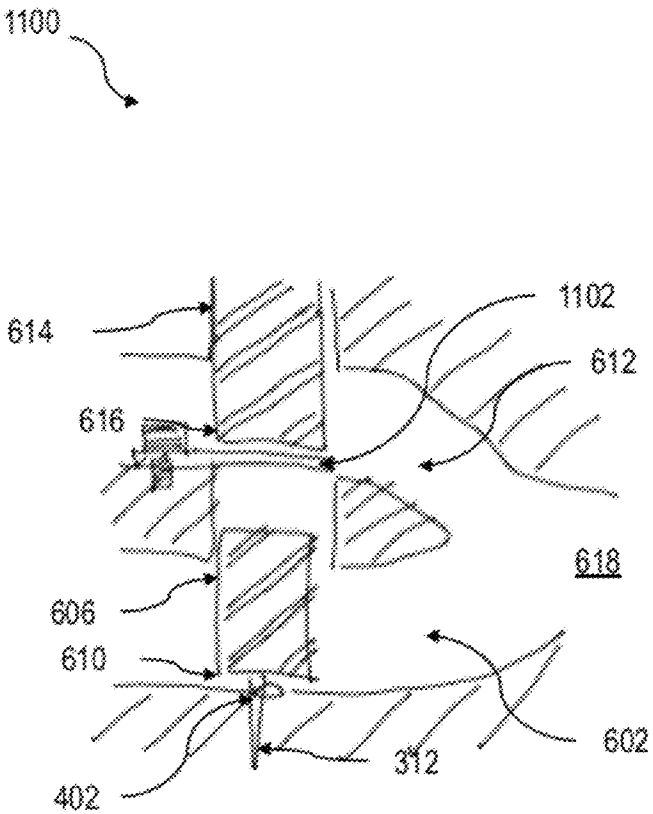

FIG. 11A and FIG. 11B show schematic views of another mixture control carburetor 1100 consistent with implementations of the current subject matter. FIG. 11A shows the carburetor 1100 in an engine idle condition, and FIG. 11B shows the carburetor 800 in a maximum power condition. The mixture control carburetor 1100 depicted in FIG. 11A and FIG. 11B makes use of airflow dilution features to provide airflow-independent control of an air/fuel ratio. In the carburetor 1100, a spring insert 1102 is position above the upper edge of the first slide part 606 such that as the first slide part 606 moves upward, the spring insert 1102 can be deflected to progressively block air flow through the second airflow passage 612 to generate richer mixtures required during high power delivery in the second operating regime of the engine and eliminate the need for a secondary throttle 624 (see FIG. 6 and FIG. 7). This configuration of a carburetor can work with direct actuation of the slide mechanism via the throttle control device and can also work with a diaphragm actuated slide mechanism. In another variation, the spring insert can instead be a float device that can be spring retained or, alternatively, gravity retained such that it only moves to block airflow through the second airflow passage when urged upward by the upper edge of the first slide part 606. In another variation, the spring insert 1102 can instead be a hinged insert. In another variation, a sliding core in the center of the slide can be used to block the diluting flow. Such a configuration can advantageously improve gradual changes to the mixture richness.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural and/or object-oriented programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations or embodiments may be within the scope of the following claims.

What is claimed is:

1. A method comprising:

receiving a first throttle control input, the first throttle control input comprising activation of a throttle control device within a first control range, the first throttle control input corresponding to a first output power of an internal combustion engine in a first output power range between zero and a transition output power level, the throttle control device causing operation of a mixture control carburetor to provide variation between at least a first air/fuel ratio and a second air/fuel ratio, the mixture control carburetor comprising separately actuated controls for movement of a slide that determines an airflow throat size and for movement of a tapered needle that is extendible and retractable from the slide into an orifice or jet to control a fuel delivery area of the orifice or jet;

operating the internal combustion engine in a first operating regime in response to the received first throttle control input to deliver the first output power, the first operating regime comprising delivering, to a combustion volume of the internal combustion engine, inlet air and fuel to produce a first air-fuel mixture within the combustion volume, the first air-fuel mixture comprising the first air/fuel ratio;

receiving a second throttle control input, the second throttle control input comprising activation of the throttle control device within a second control range, the second throttle control input corresponding to a second output power of the internal combustion engine in a second output power range between the transition output power level and a maximum output power level of the internal combustion engine; and operating the internal combustion engine in a second operating regime in response to the received second throttle control input to deliver the second output power, the second operating regime comprising delivering, to the combustion volume of the internal combustion engine, inlet air and fuel to produce a second air-fuel mixture within the combustion volume, the second air-fuel mixture comprising the second air/fuel ratio that is richer than the first air/fuel ratio.

2. A method as in claim 1, further comprising providing a feedback to indicate that the second control range has been activated.

3. A method as in claim 1, wherein the first operating regime further comprises a first ignition timing and the second operating regime further comprises a second ignition timing that is retarded relative to the first ignition timing.

4. A method as in claim 1, wherein variation between the first air/fuel ratio and the second air/fuel ratio is provided by actuation of a throttle to control airflow to the internal combustion engine and concurrent, independent control of a delivery rate of fuel via one or more fuel injectors.

5. A method as in claim 4, further comprising controlling the delivery rate of fuel via the one or more fuel injectors by a programmable processor that receives commands from the throttle control device.

6. A method as in claim 1, wherein the mixture control carburetor comprises one or more airflow dilution features that provide airflow-independent control delivery of a required air/fuel ratio.

7. A system comprising:

a user-operable throttle control device operable to receive at least two throttle control inputs, the first throttle control input comprising activation of the throttle control device within a first control range, the first throttle control input corresponding to a first output power of an internal combustion engine in a first output power range between zero and a transition output power level, the second throttle control input comprising activation of the throttle control device within a second control range, the second throttle control input corresponding to a second output power of the internal combustion engine in a second output power range between the transition output power level and a maximum output power level of the internal combustion engine; and a control mechanism causing the internal combustion engine to operate in a first operating regime in response to receiving the first throttle control input requesting the first output power in the first output power range, the first operating regime comprising delivering, to a combustion volume of the internal combustion engine, inlet air and fuel to produce a first air-fuel mixture within the combustion volume, the first air-fuel mixture comprising a first air/fuel ratio, the control mechanism further causing the internal combustion engine to operate in a second operating regime in response to receiving the second throttle control input requesting the second output power in the second output power range, the second operating regime comprising delivering, to the combustion volume, inlet air and fuel to produce a second air-fuel mixture within the combustion volume, the second air-fuel mixture comprising a second air/fuel ratio that is richer than the first air/fuel ratio, the control mechanism comprising a mixture control carburetor operable to provide variation between at least the first air/fuel ratio and the second air/fuel ratio the mixture control carburetor comprising separately actuated controls for movement of a slide that determines an airflow throat size and a position of an orifice or jet into and out of which a tapered needle mounted on the slide is moved in concert with motion of the slide to control a fuel delivery area of the orifice or jet.

8. A system as in claim 7, further comprising a feedback system that provides a feedback to indicate that the second control range has been activated, the feedback system comprising at least one of an increased throttle control device motion resistance mechanism that increases a resistance to motion of the throttle control device in the second control range relative to the first control range, a visual feedback, an auditory feedback, and a tactile feedback that is not related to motion resistance of the throttle control device.

9. A system as in claim 7, wherein the first operating regime further comprises a first ignition timing and the second operating regime further comprises a second ignition timing that is retarded relative to the first ignition timing.

10. A system as in claim 7, wherein the control mechanism comprises a throttle to control airflow to the internal combustion engine and one or more fuel injectors to provide concurrent, independent control of a delivery rate of fuel.

11. A system as in claim 10, further comprising a programmable processor that receives commands from the throttle control device and that controls the delivery rate of fuel via the one or more fuel injectors.

12. A system as in claim 7, wherein the mixture control carburetor comprises one or more airflow dilution features that provide airflow-independent control of a required air/fuel ratio.

13. A system as in claim 12, wherein the one or more airflow dilution features comprise a secondary throttle metering airflow through a second air passage that dilutes air passing through a first airflow passage that comprises a controlled rate of fuel delivery from an orifice or jet.

14. A mixture control carburetor comprising:

a fuel mixture control mechanism configured to receive at least a first throttle control input and a second throttle control input from a throttle control device, the first throttle control input comprising activation of a throttle control device within a first control range, the first throttle control input corresponding to a first output power of an internal combustion engine in a first output power range between zero and a transition output power level, the second throttle control input comprising activation of the throttle control device within a second control range, the second throttle control input corresponding to a second output power of the internal combustion engine in a second output power range between the transition output power level and a maximum output power level of the internal combustion engine, the fuel mixture control mechanism comprising at least one of:

a variable fuel delivery rate feature providing airflow-independent control of a required air/fuel ratio, the variable fuel delivery rate feature comprising separately actuated controls for movement of a slide that determines an airflow throat size and for movement of a tapered needle that is extendible and retractable from the slide into an orifice or jet to control a fuel delivery area of the orifice or jet, and an airflow dilution feature providing airflow-independent control of the required air/fuel ratio, the airflow dilution feature comprising separately actuated controls for movement of the slide that determines the airflow throat size and a position of the orifice or jet into and out of which the tapered needle, which is mounted on the slide, is moved in concert with motion of the slide to control a fuel delivery area of the orifice or jet, wherein the fuel mixture control mechanism produces a first air-fuel mixture comprising a first air/fuel ratio in response to receiving the first throttle control input, and produces a second air-fuel mixture comprising a second air/fuel ratio in response to receiving the second throttle control input, the second air/fuel ratio being richer than the first air/fuel ratio.

15. A method comprising:

receiving a first throttle control input, the first throttle control input comprising activation of a throttle control device within a first control range, the first throttle control input corresponding to a first output power of an internal combustion engine in a first output power range between zero and a transition output power level, the throttle control device causing operation of a mixture control carburetor to provide variation between at least a first air/fuel ratio and a second air/fuel ratio, the mixture control carburetor comprising separately actuated controls for movement of a slide that determines an airflow throat size and a position of an orifice or jet into and out of which a tapered needle mounted on the slide is moved in concert with motion of the slide to control a fuel delivery area of the orifice or jet;

operating the internal combustion engine in a first operating regime in response to the received first throttle control input to deliver the first output power, the first operating regime comprising delivering, to a combustion volume of the internal combustion engine, inlet air and fuel to produce a first air-fuel mixture within the combustion volume, the first air-fuel mixture comprising the first air/fuel ratio;

receiving a second throttle control input, the second throttle control input comprising activation of the throttle control device within a second control range, the second throttle control input corresponding to a second output power of the internal combustion engine in a second output power range between the transition output power level and a maximum output power level of the internal combustion engine; and operating the internal combustion engine in a second operating regime in response to the received second throttle control input to deliver the second output power, the second operating regime comprising delivering, to the combustion volume of the internal combustion engine, inlet air and fuel to produce a second air-fuel mixture within the combustion volume, the second air-fuel mixture comprising the second air/fuel ratio that is richer than the first air/fuel ratio.

16. A method as in claim 15, further comprising providing a feedback to indicate that the second control range has been activated.

17. A method as in claim 15, wherein the first operating regime further comprises a first ignition timing and the second operating regime further comprises a second ignition timing that is retarded relative to the first ignition timing.

18. A method as in claim 15, wherein variation between the first air/fuel ratio and the second air/fuel ratio is provided by actuation of a throttle to control airflow to the internal combustion engine and concurrent, independent control of a delivery rate of fuel via one or more fuel injectors.

19. A method as in claim 18, further comprising controlling the delivery rate of fuel via the one or more fuel injectors by a programmable processor that receives commands from the throttle control device.

20. A method as in claim 15, wherein the mixture control carburetor comprises one or more airflow dilution features that provide airflow-independent control delivery of a required air/fuel ratio.

21. A system comprising:

a user-operable throttle control device operable to receive at least two throttle control inputs, the first throttle control input comprising activation of the throttle control device within a first control range, the first throttle control input corresponding to a first output power of an internal combustion engine in a first output power range between zero and a transition output power level, the second throttle control input comprising activation of the throttle control device within a second control range, the second throttle control input corresponding to a second output power of the internal combustion engine in a second output power range between the transition output power level and a maximum output power level of the internal combustion engine; and a control mechanism causing the internal combustion engine to operate in a first operating regime in response to receiving the first throttle control input requesting the first output power in the first output power range, the first operating regime comprising delivering, to a combustion volume of the internal combustion engine, inlet air and fuel to produce a first air-fuel mixture within the combustion volume, the first air-fuel mixture comprising a first air/fuel ratio, the control mechanism further causing the internal combustion engine to operate in a second operating regime in response to receiving the second throttle control input requesting the second output power in the second output power range, the second operating regime comprising delivering, to the combustion volume, inlet air and fuel to produce a second air-fuel mixture within the combustion volume, the second air-fuel mixture comprising a second air/fuel ratio that is richer than the first air/fuel ratio, the control mechanism comprising a mixture control carburetor operable to provide variation between at least the first air/fuel ratio and the second air/fuel ratio, the mixture control carburetor comprising separately actuated controls for movement of a slide that determines an airflow throat size and for movement of a tapered needle that is extendible and retractable from the slide into an orifice or jet to control a fuel delivery area of the orifice or jet.

22. A system as in claim 21, further comprising a feedback system that provides a feedback to indicate that the second control range has been activated, the feedback system comprising at least one of an increased throttle control device motion resistance mechanism that increases a resistance to motion of the throttle control device in the second control range relative to the first control range, a visual feedback, an auditory feedback, and a tactile feedback that is not related to motion resistance of the throttle control device.

23. A system as in claim 21, wherein the first operating regime further comprises a first ignition timing and the second operating regime further comprises a second ignition timing that is retarded relative to the first ignition timing.

24. A system as in claim 21, wherein the control mechanism comprises a throttle to control airflow to the internal combustion engine and one or more fuel injectors to provide concurrent, independent control of a delivery rate of fuel.

25. A system as in claim 24, further comprising a programmable processor that receives commands from the throttle control device and that controls the delivery rate of fuel via the one or more fuel injectors.

26. A system as in claim 21, wherein the mixture control carburetor comprises one or more variable fuel delivery rate features to provide airflow-independent control of a required air/fuel ratio.

27. A system as in claim 21, wherein the mixture control carburetor comprises one or more airflow dilution features that provide airflow-independent control of a required air/fuel ratio.

28. A system as in claim 27, wherein the one or more airflow dilution features comprise a secondary throttle metering airflow through a second air passage that dilutes air passing through a first airflow passage that comprises a controlled rate of fuel delivery from an orifice or jet.

* * * * *